US005903248A

United States Patent [19]

Irwin

[11] Patent Number: 5,903,248

[45] Date of Patent: May 11, 1999

[54] ACTIVE MATRIX DISPLAY HAVING PIXEL DRIVING CIRCUITS WITH INTEGRATED CHARGE PUMPS

[75] Inventor: Dean S. Irwin, Novato, Calif.

[73] Assignee: Spatialight, Inc., Novato, Calif.

[21] Appl. No.: 08/838,917

[22] Filed: Apr. 11, 1997

[51] Int. Cl.[6] ..... G09G 3/36

[52] U.S. Cl. ..... 345/90; 345/92; 345/98; 345/211

[58] Field of Search ..... 345/87–104, 211

[56] References Cited

U.S. PATENT DOCUMENTS 5,229,761 7/1993 Fuse ..... 345/211
5,581,273 12/1996 Yoneda et al. ..... 345/90
5,686,932 11/1997 Tomita ..... 345/92
5,731,795 3/1998 Kanda et al. ..... 345/98

*Primary Examiner*—Steven J. Saras
*Assistant Examiner*—David L Lewis
*Attorney, Agent, or Firm*—Gray Cary Ware & Freidenrich

[57] ABSTRACT

A pixel driving circuit (400) receives a signal voltage VA from a column bus (403) and generates therefrom, a back plate electrode voltage VB which is approximately twice that of a signal voltage VA. Included in the pixel driving circuit (400) are three transistors (402, 407 and 408) and a storage capacitor (404). During a first time period, two of the three transistors turn on to charge up or discharge the storage capacitor to the signal voltage VA, while the third transistor (407) is turned off, and during a second time, the third transistor (407) is turned on to effectively double the voltage provided to the back plate electrode, while the other two of the three transistors are turned off.

12 Claims, 6 Drawing Sheets

+12V
Vcom
-2V

VA
(clear)
+5V
0V

VCS1
+5V
0V

VCS2
+5V
0V

+10V
VB
+5V

+12V
Vpixel
(clear)
-12V t0 t1 t2 t3 t4 t5 t6 t7 t8 t9 t

ACTIVE MATRIX DISPLAY HAVING PIXEL DRIVING CIRCUITS WITH INTEGRATED CHARGE PUMPS

FIELD OF THE INVENTION

This invention relates in general to active matrix displays and in particular, to pixel driving circuits for high voltage active matrix displays.

BACKGROUND OF THE INVENTION

An especially popular type of active matrix display is an active matrix liquid crystal display ("AMLCD") formed by confining a thin layer of liquid crystal material between a front plate having a front electrode, and a back plate having a matrix of back electrodes. The front plate typically comprises a transparent material such as glass, and the back plate typically comprises a glass substrate with processed thin-film or amorphous silicon transistors for transmissive type AMLCDs, or a silicon substrate with processed MOS transistors for reflective type AMLCDs. Pixels are defined by the front and back electrodes so as to be optically responsive to voltages applied across liquid crystal material residing between the front and back electrodes.

In conventional AMLCDs, although the voltage applied to the front electrode is not necessarily restricted in magnitude since it may readily be generated as an analog signal, the voltages applied to the back electrodes commonly are restricted for convenience in their generation, to logic level voltages such as the 5.0 volts commonly used by digital circuitry. In certain applications, however, such a restricted voltage may result in compromising the performance of the AMLCD. For examples, it may preclude the use of certain liquid crystal materials such as electroclinic liquid crystal materials, which require high voltages for proper operation, or it may limit the range or application of certain other liquid crystal materials such as nematic liquid crystal material, wherein a high voltage range is desirable for high resolution gray scale applications.

OBJECTS AND SUMMARY OF THE INVENTION

Accordingly, it is an object of the present invention to provide a pixel driving circuit compatible with conventional digital circuitry for generating pixel display voltages over a wide voltage range.

Another object of the present invention is to provide a structure for a pixel driving circuit that is easily manufactured using conventional digital circuitry processes, and is low cost.

These and additional objects are accomplished by the various aspects of the present invention, wherein briefly stated, one aspect is a pixel driving circuit (e.g., 400 in FIG. 4) useful in an active matrix display for providing a back plate voltage (e.g., VB) to a back plate electrode (e.g., 410) of a pixel (e.g., 406) such that the back plate voltage is approximately double a signal voltage (e.g., VA) indicative of a desired display level for the pixel. Included in the pixel driving circuit (e.g., 400) are a storage capacitor (e.g., 404) having a first end coupled to the backplate electrode (e.g., 410), and switching means (e.g., 402, 408, and 407) responsive to at least one control signal.(e.g., VCS1 and VCS2) for coupling the signal voltage to the first end of the storage capacitor until a capacitor voltage approximately equal to the signal voltage is generated across the storage capacitor, and decoupling the signal voltage from the first end of the storage capacitor and coupling the signal voltage to a second end of the storage capacitor so that the first end of the storage capacitor provides the back plate voltage having approximately twice the voltage of the signal voltage to the back plate electrode.

Another aspect is a back plate structure (e.g., 500 in FIG. 5) for a liquid crystal display, comprising: a reflective electrode (e.g., 501); a storage capacitor (e.g., 404 in pixel driving circuit 400 of FIG. 4, which is representative of pixel driving circuit 601 in FIG. 5) coupled to the reflective electrode, and formed substantially beneath the reflective electrode so as to be screened by the reflective electrode from incident light entering the liquid crystal display; and switching means (e.g. 402, 408 and 407 in representative pixel driving circuit 400) responsive to at least one control signal (e.g., VCS1 and VCS2) for coupling the signal voltage (e.g., VA) to a first end of the storage capacitor until a capacitor voltage approximately equal to the signal voltage is generated across the storage capacitor, and decoupling the signal voltage from the first end of the storage capacitor and coupling the signal voltage to a second end of the storage capacitor so that the first end of the storage capacitor provides a back plate voltage having approximately twice the voltage of the signal voltage to the back plate electrode, the switching means also formed substantially beneath the reflective electrode so as to be screened by the reflective electrode from incident light entering the liquid crystal display.

Still another aspect is a method of generating a voltage for a back plate electrode of a liquid crystal display, comprising the steps of: charging a storage capacitor coupled to the back plate electrode to a signal voltage, and charging the storage capacitor to a voltage approximately twice the voltage of the signal voltage by coupling the signal voltage to a low voltage end of the storage capacitor.

Additional objects, features and advantages of the various aspects of the present invention will become apparent from the following description of its preferred embodiments, which description should be taken in conjunction with the accompanying drawings.

DETAILED DESCRIPTION OF THE PREFERRED EMBODIMENT

Figure 1:
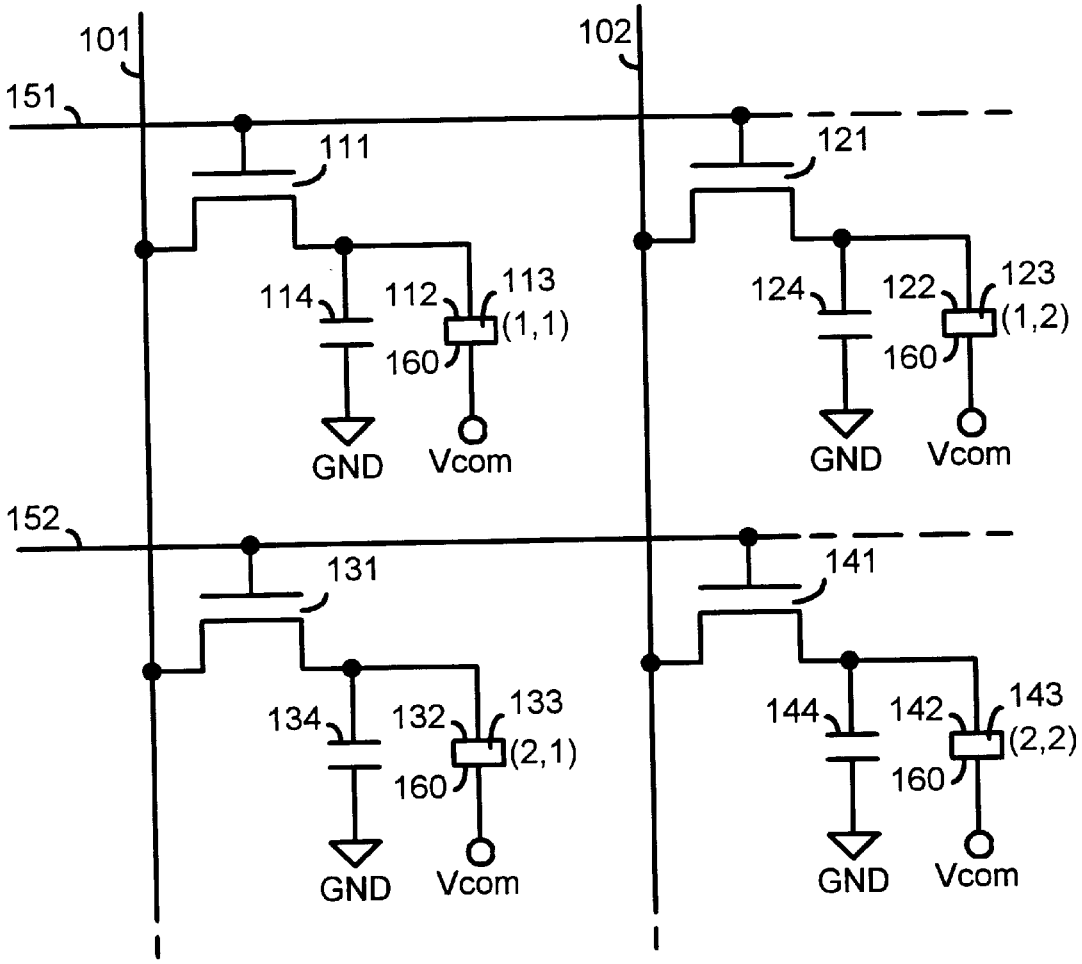
fig.1 prior art
FIG. 1 illustrates, as an example, a circuit schematic of a portion of a conventional circuit used for activating selected pixels in a matrix array of pixels of an AMLCD.

FIG. 1 illustrates, as an example, a circuit schematic including representative pixels of a conventional AMLCD, and pixel driving circuits for the pixels. Pixel (1,1) comprises a back electrode 112, a common front electrode 160, and liquid crystal material 113 sandwiched between the back and common front electrodes, 112 and 160. A pixel driving circuit comprising a transistor 111 and a storage capacitor 114, serve as an elemental sample and hold circuit for the pixel (1,1). The transistor 111 has a control gate coupled to a row bus 151, a drain electrode coupled to a column bus 101, and a source electrode coupled to the storage capacitor 114 and the back electrode 112 of the pixel (1,1). The other end of the storage capacitor 114 is coupled to a ground reference GND.

Other pixels of the AMLCD are similarly constructed, as are their pixel driving circuits. Each row of pixels is formed such that the control gates of its pixel driving circuit transistors are coupled to a common row bus, and each column of pixels is formed such that the drain electrodes of its pixel driving circuit transistors are coupled to a common column bus. To display a frame of images or text on the AMLCD, appropriate signal voltages are provided to the column buses which are properly timed with row scanning signals being sequentially provided to the row buses, and a voltage Vcom being provided to the common front electrode 160.

FIGS. 2*a*–2*e* illustrate, as examples, timing diagrams of selected voltages for one or more pixel driving circuits operating in binary monochrome mode. In the examples, the liquid crystal display is a reflective-type having twisted nematic liquid crystal material and a front polarizer oriented so that a pixel appears opaque to incident polarized light when its molecules are in an untwisted state, and appears clear or transparent to incident polarized light when its molecules are in a fully twisted state. Also in the following examples, the liquid crystal material has a threshold voltage of 2.0 volts so that the liquid crystal molecules of a pixel are normally in an untwisted state when a pixel display voltage Vpixel having an absolute value less than or equal to the threshold value of the liquid crystal material is applied across front and back electrodes of the pixel (e.g., $|Vpixel| \leqq Vth$, or $|Vpixel| \leqq 2$ volts), and conversely, are normally in a partially or fully twisted state when a pixel display voltage Vpixel having an absolute value greater than the threshold voltage is applied across the front and back electrodes of the pixel (e.g., $|Vpixel| > Vth$, or $|Vpixel| > 2$ volts). As the magnitude of the pixel display voltage Vpixel increases, the twist of the liquid crystal molecules increases and consequently, the transparency of the pixel to incident polarized light increases, until the liquid crystal molecules are fully twisted and the pixel is fully transparent to incident polarized light.

Figure 2A:
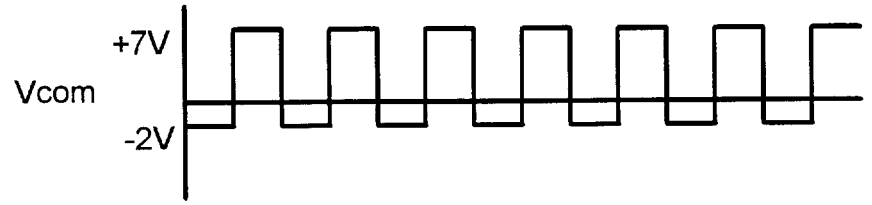
fig.2a prior art
FIGS. 2*a*–2*e* illustrate, as examples, timing diagrams for selected voltages from a conventional binary monochrome LCD pixel driving circuit.
Figure 2B:
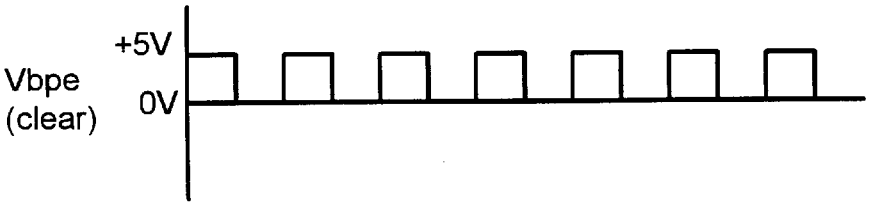
fig.2b prior art
Figure 2C:
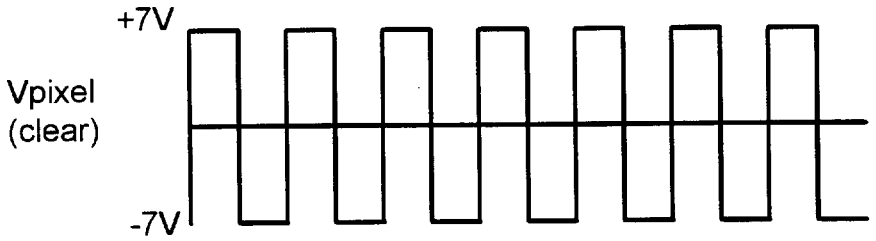
fig.2c prior art

FIG. 2*a* illustrates a voltage signal Vcom being applied to the common front electrode 160 of the AMLCD. The common front plate voltage signal Vcom is depicted as an AC signal having a DC offset. FIG. 2*b* illustrates a voltage signal Vbe being applied to a back electrode of the AMLCD. The back plate voltage signal Vbe is depicted as an AC signal 180 degrees out of phase with the front plate voltage signal Vcom and alternating between high and low logic level voltages of 5.0 and 0.0 volts. FIG. 2*c* illustrates a pixel display voltage Vpixel resulting from a difference of the back plate voltage signal Vbe of FIG. 2*b* and the front plate voltage signal Vcom of FIG. 2*a*. The resulting pixel display voltage Vpixel has an absolute value of 7.0 volts, which drives its corresponding pixel into a clear or transparent state since 7.0 volts is much greater than the LCD material threshold voltage of 2.0 volts.

Figure 2D:
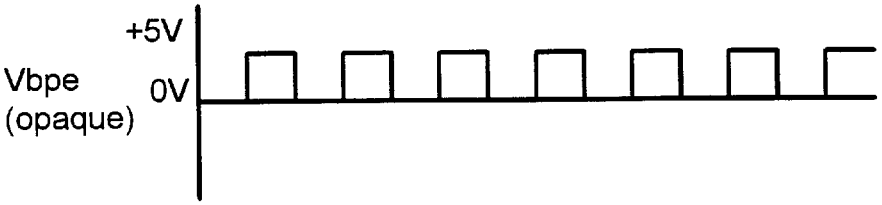
fig.2d prior art
Figure 2E:
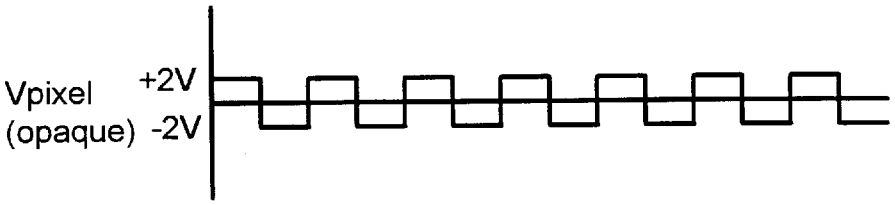
fig.2e prior art

FIG. 2*d*, on the other hand, illustrates another voltage signal Vbe being applied to a back electrode of the AMLCD. The back plate voltage signal Vbe is depicted as an AC signal in phase with the front plate voltage signal Vcom and alternating between low and high logic level voltages of 0.0 and 5.0 volts. FIG. 2*e* illustrates a pixel display voltage Vpixel resulting from the difference of the back plate voltage signal Vbe of FIG. 2*d* and the front plate voltage signal Vcom of FIG. 2*a*. The resulting pixel display voltage Vpixel has an absolute value of 2.0 volts, which drives its corresponding pixel into an opaque state since 2.0 volts is equal to the LCD material threshold voltage of 2.0 volts. By driving the opaque pixel with a pixel display voltage at or just below its threshold voltage level, the response time for turning the opaque pixel into a clear pixel is reduced.

Frames of images are thereupon displayed in a normal mode of operation on a AMLCD by applying AC signals such as depicted in FIG. 2*b*, which are 180 out of phase with the front plate voltage signal Vcom, to back electrodes which are to be clear, and AC signals such as depicted in FIG. 2*d*, which are in phase with the front plate voltage signal Vcom, to back electrodes which are to be opaque. In a reverse mode of operation, clear pixels in normal mode operation are displayed as opaque pixels, and opaque pixels in normal mode operation are displayed as clear pixels by reversing the phase relationships of their back plate and front plate voltage signals.

For convenience, the front plate voltage signal Vcom is referred to as being in a first polarity mode when it is at a maximum value of 7.0 volts, and in a second polarity mode when it is at a minimum value of −2.0 volts. Back plate voltage signals Vbe for normal mode clear pixels and reverse mode opaque pixels are referred to as being in the first polarity mode when they are at a minimum value of 0 volts, and in the second polarity mode when they are at a maximum value of 5.0 volts. Back plate voltage signals Vbe for normal mode opaque pixels and reverse mode clear pixels are referred to as being in the first polarity mode when they are at a maximum value of 5.0 volts, and in the second polarity mode when they are at a minimum value of 0 volts. As a consequence, when the front plate voltage signal Vcom is in the same polarity mode as the back plate voltage signals Vbe, images are being displayed on the AMLCD in normal mode operation, and when the front plate voltage signal Vcom is in a different polarity mode than the back plate voltage signals Vbe, images are being displayed on the AMLCD in reverse mode operation.

Figure 3A:
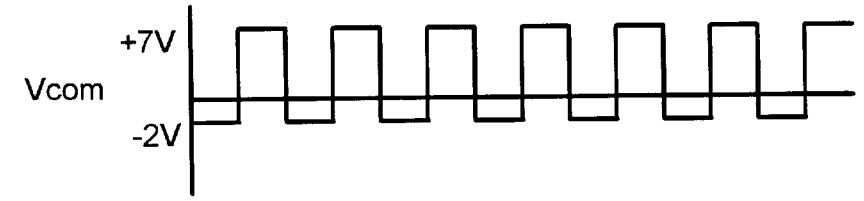
fig.3a prior art
FIGS. 3*a*–3*e* illustrate, as examples, timing diagrams for selected voltages from a conventional gray scale monochrome LCD pixel driving circuit.

FIGS. 3*a*–3*e* illustrate, as examples, timing diagrams for selected voltages of one or more pixel driving circuits operating in gray scale monochrome mode. As in the examples of FIGS. 2*a*–2*e*, the liquid crystal material is a twisted nematic type, and has a threshold voltage of 2 volts. As shown in FIG. 3*a*, the voltage signal Vcom being applied to the common front plate electrode of the AMLCD, is identical with that of FIG. 2*a*. Consequently, by providing a voltage signal Vbpe identical with that of FIG. 2*b* to a back plate electrode of the AMLCD, a pixel display voltage Vpixel having a maximum value is generated, and the corresponding pixel is driven to an extreme end of the gray scale displaying a clear or transparent pixel to incident polarized light. Likewise, by providing a voltage signal Vbpe identical with that of FIG. 2*d* to a back plate electrode of the AMLCD, a pixel display voltage Vpixel having a minimum value is generated, and the corresponding pixel is driven to an opposite extreme end of the gray scale displaying an opaque pixel.

Figure 3B:
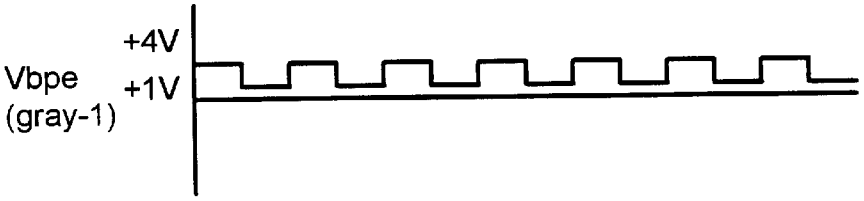
fig.3b prior art
Figure 3C:
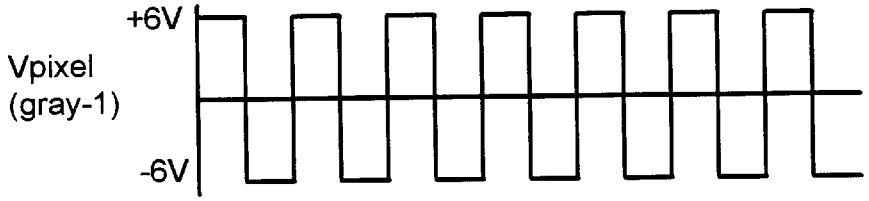
fig.3c prior art
Figure 3D:
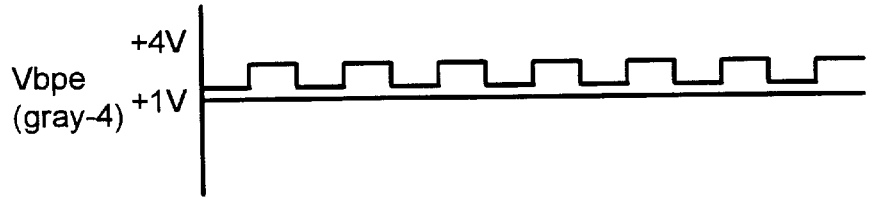
fig.3d prior art
Figure 3E:
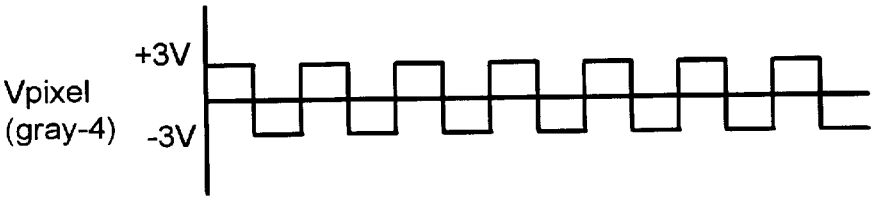
fig.3e prior art

FIGS. 3*b* and 3*d* illustrate two voltage signals Vbpe that respectively generate the pixel display voltages Vpixel of FIGS. 3*c* and 3*e* having intermediate values relative to the pixel display voltages Vpixel of FIGS. 2*c* and 2*e*. FIG. 3*b* illustrates a voltage signal Vbpe being applied to a back plate electrode of the AMLCD to drive its corresponding pixel into a transparency state which is less clear (more opaque) than that of the voltage signal Vbpe of FIG. 2*b*, and FIG. 3*d* illustrates a voltage signal Vbpe being applied to a back plate electrode of the AMLCD to drive its corresponding pixel into a transparency state which is less opaque (more clear) than that of the voltage signal Vbpe of FIG. 2*d*. FIG. 3*c* illustrates a pixel display voltage Vpixel having an absolute value of 6 volts resulting from the difference of the back plate electrode voltage signal Vbpe of FIGS. 3*b* and the front plate voltage signal Vcom of FIG. 3*a*, and FIG. 3*e* illustrates a pixel display voltage Vpixel having an absolute value of 3 volts resulting from the difference of the back plate electrode voltage signal Vbpe of FIGS. 3*d* and the front plate voltage signal Vcom of FIG. 3*a*. Since the level of transparency increases with increasing absolute voltage values, the pixels corresponding to the pixel display voltages of FIGS. 2*e*, 3*e*, 3*c*, and 2*c* display a range of transparency levels extending from a fully opaque level to increasingly more clear or transparent levels.

For high gray scale resolution, it is necessary to define a large number of such intermediate transparency levels and therefore, it desirable to have a wide voltage range for the pixel display voltage Vpixel. By using conventional digital circuitry such as those comprising field-effect transistors (FETS) of the complementary metal oxide semiconductor (CMOS) type in the circuit of FIG. 1, however, the voltage range for the pixel display voltage Vpixel is practically limited by the logic level voltages employed by such digital circuitry. For example, with a threshold voltage of 2 volts for the liquid crystal material, and low and high logic level voltages of 0.0 and 5.0 volts, the maximum voltage range for the pixel display voltage Vpixel is ±7.0 volts, as depicted in FIG. 2*c*. Although higher voltage processes exist, they are not as readily available from silicon foundries, nor are they generally as reliable or cost effective as such conventional CMOS processes Therefore, it is highly desirable to use such conventional digital circuitry for processed silicon substrates fabricated for use as back plates of AMLCDs, despite their limited voltage ranges.

Figure 4:
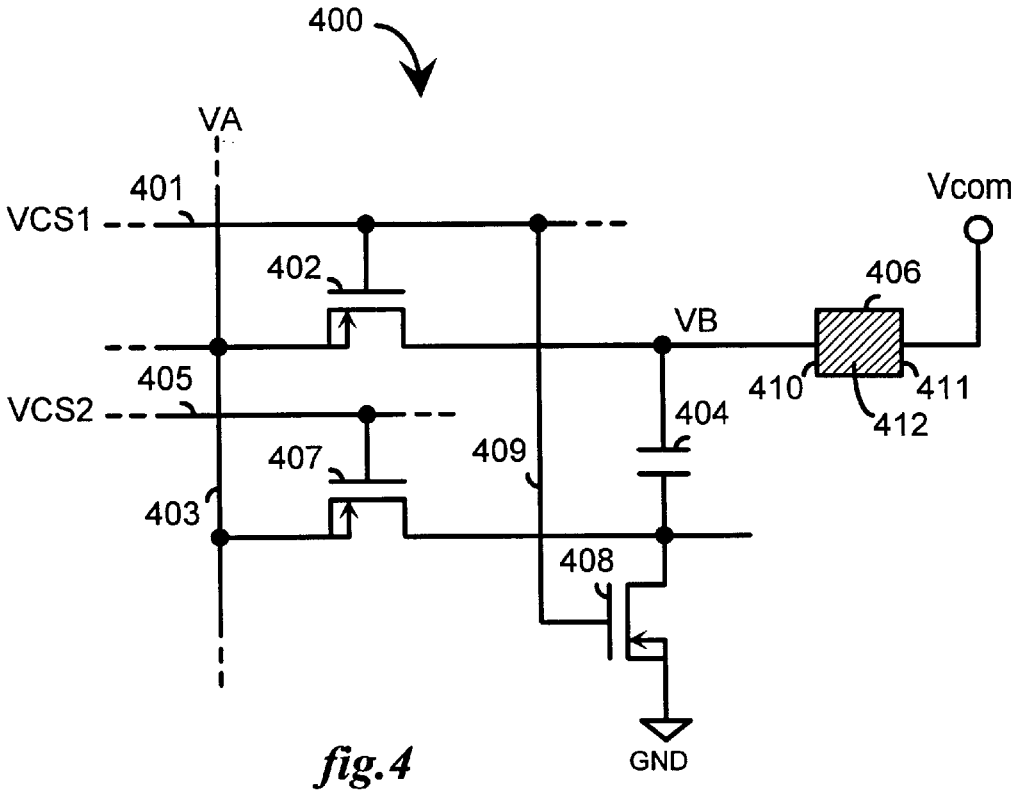
FIG. 4 illustrates, as an example, a pixel driving circuit with an integrated voltage doubler utilizing aspects of the present invention.

FIG. 4 illustrates a pixel driving circuit 400 for driving a pixel 406 of an AMLCD. The pixel 406 is conventionally formed of a back plate electrode 410, a front plate electrode 411, and liquid crystal material 412 residing inbetween the back and front plate electrodes, 410 and 411. The back plate electrode 410 is coupled to the pixel driving circuit 400, and the front plate electrode 411 is coupled to a front plate voltage Vcom provided by drive circuitry (not shown) of the AMLCD. A pixel display voltage Vpixel across the pixel 406, equals the difference between the voltages on the back and front plate electrodes, 410 and 411.

Included in the pixel driving circuit 400 are a storage capacitor 404, and transistors 402, 407 and 408. Transistor 402 has a drain coupled to a column bus 403, a source coupled to a high voltage end of the storage capacitor 404 and to the back plate electrode 410, and a gate coupled to a first row bus 401. A signal voltage VA, which is indicative of a desired display level for the pixel 412, is provided by column drive circuitry (e.g., 702 in FIG. 7) along the column bus 403, and a first control signal VCS1 is provided by row drive circuitry (e.g., 703 in, FIG. 7) along the first row bus 401. Transistor 407 has a drain coupled to the column bus 403, a source coupled to a low voltage end of the storage capacitor 404, and a gate coupled to a second row bus 405. A second control signal VCS2 is provided by row drive circuitry (e.g., 703 in FIG. 7) along the second row bus 405. Transistor 408 has a source coupled to the low voltage end of the storage capacitor 404 and to the source of the transistor 407, a drain coupled to a low voltage reference GND, and a gate coupled through strap 409 to the first row bus 401.

Figure 5:
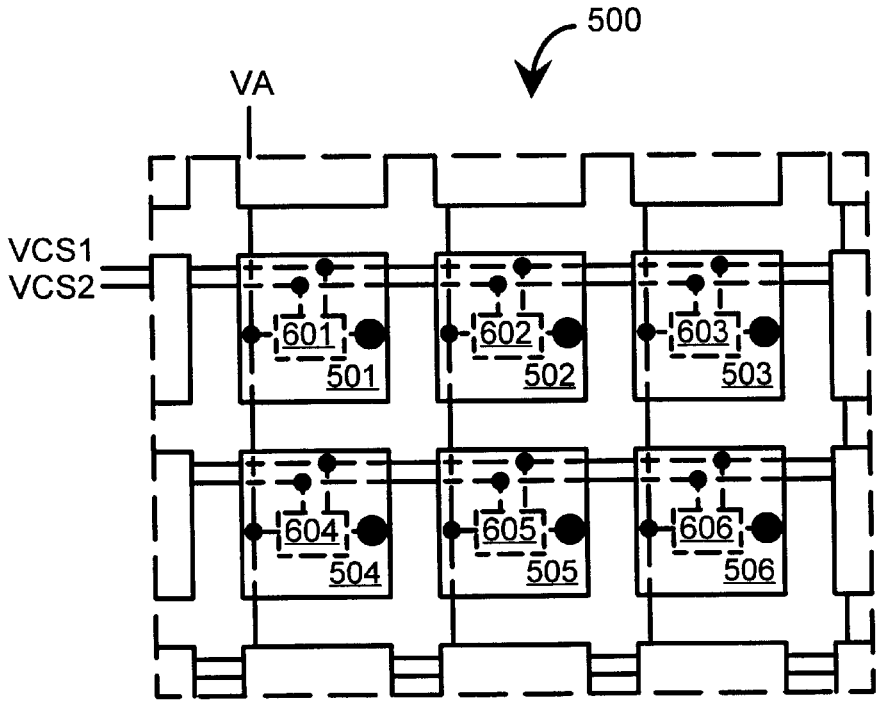
FIG. 5 illustrates, as an example, a top plan view of a portion of a back plate structure of an LCD utilizing aspects of the present invention.

FIG. 5 illustrates, as an example, a top plan view of a portion of the back plate structure of the AMLCD. Conventionally formed on the back plate structure are a matrix of reflective back plate electrodes 501–506. Conventionally formed beneath each of the reflective back plate electrodes 501–506 is a corresponding pixel driving circuit 601–606, resembling pixel driving circuit 400 of FIG. 4. In particular, each of the pixel driving circuits 601–606 has a capacitor such as storage capacitor 404, and three transistors such as transistors 402, 407 and 408 of the pixel driving circuit 400, formed beneath their respective reflective back plate electrode so as to be screened by the reflective electrode from incident light entering the liquid crystal display. The pixel driving circuits of each row of pixels shares first and second row buses respectively providing first and second control signals VCS1 and VCS2, and the pixel driving circuits of each column of pixels shares a column bus providing a signal voltage VA.

FIGS. 6*a*–6*f* illustrate, as examples, timing diagrams for selected voltages from the pixel driving circuit 400 of FIG. 4 for driving the pixel 412 into a clear state. Similar timing diagrams may be readily constructed for a fully opaque pixel, and pixels of intermediate levels of transparency by using, for example, signal voltages resembling the back plate electrode voltages Vbpe of FIGS. 2*d*, 3*b* and 3*d*. As in the examples of FIGS. 2*a*–2*e* and 3*a*–3*e*, the liquid crystal material is a twisted nematic type having a threshold voltage of 2 volts.

Figures 6A, 6B, 6C, 6D, 6E, 6F:
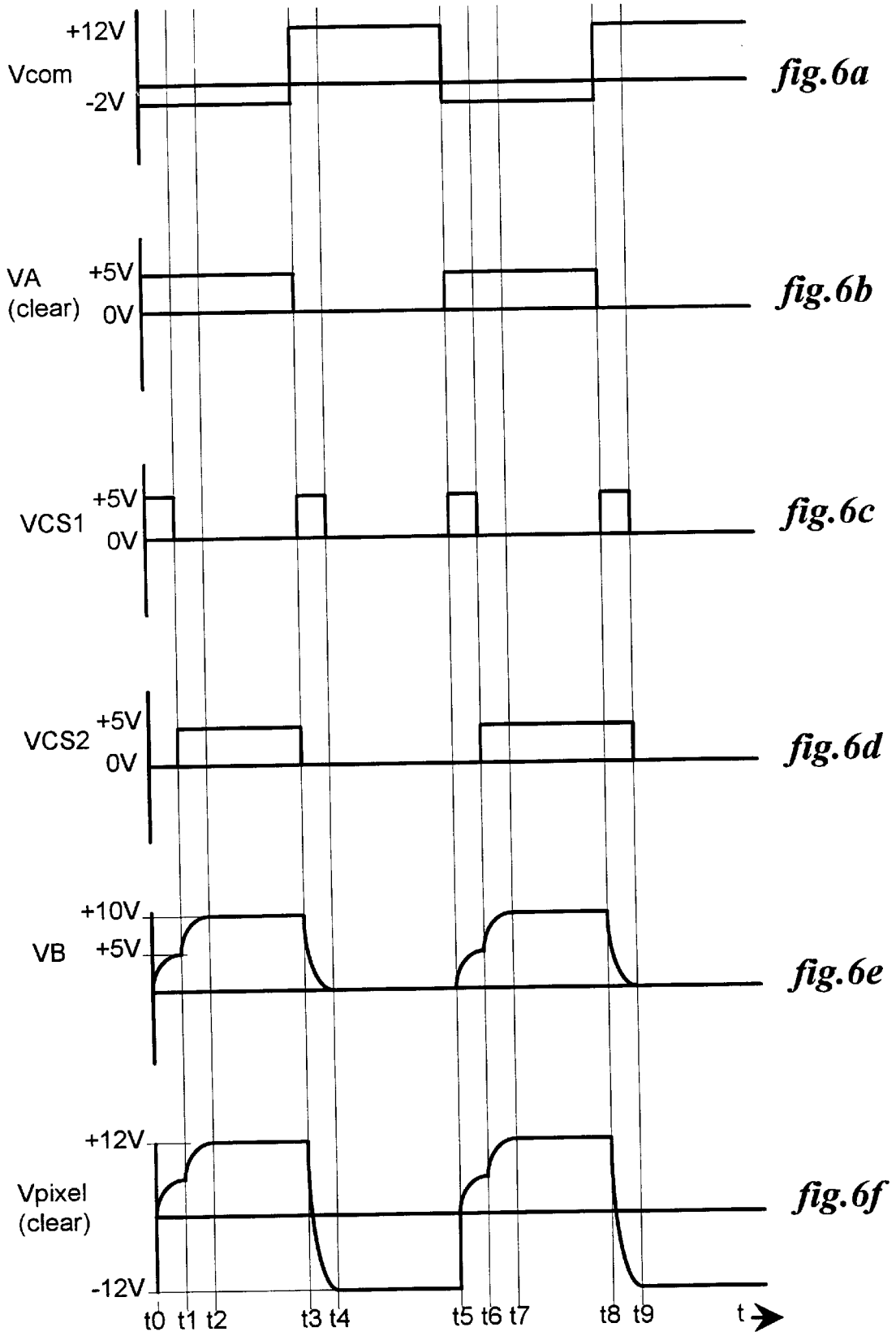
FIGS. 6*a*–6*f* illustrate, as examples, timing diagrams for selected voltages from the pixel driving circuit of FIG. 4, utilizing aspects of the present invention.

FIG. 6*a* illustrates a voltage signal Vcom applied to a front plate electrode common to all pixels of an AMLCD including the pixel driving circuit 400. Like the front plate voltage signal Vcom of FIGS. 2*a* and 3*a*, the front plate voltage signal Vcom of FIG. 6*a* is depicted as an AC signal having a DC offset. The maximum voltage of the front plate voltage signal Vcom of FIG. 6*a* (i.e., +12 volts), however, is significantly larger than that of the front plate voltage signal Vcom of FIGS. 2*a* and 3*a* (i.e., +7 volts), while the minimum voltage of the front plate voltage signal Vcom of FIG. 6*a* is the same as that of the front plate voltage signal Vcom of FIGS. 2*a* and 3*a* (i.e., −2 volts) . A DC-DC converter is conventionally employed to generate such upper end of the front plate voltage signal Vcom from a logic level voltage, for example, of 5.0 volts.

FIG. 6*b* illustrates the signal voltage VA being provided at the drain inputs of the transistors 402 and 407. Like the back plate voltage signal Vbpe of FIG. 2*b*, the signal voltage VA is depicted as an AC signal 180 degrees out of phase with the front plate voltage signal Vcom and alternating between high and low logic level voltages of 5.0 and 0.0 volts.

FIG. 6*c* illustrates, as an example, the first control signal VCS1 applied to the control gates of transistors 402 and 408, and FIG. 6*d* illustrates, as an example, the second control signal VCS2 applied to the control gate of transistor 407. For a duration of time between time t0 and t1, the first control signal VCS1 is HIGH so that the transistors 402 and 408 turn on, and the second control signal VCS2 is LOW so that the transistor 407 is turned off, resulting in the voltage across the storage capacitor 404 being charged up to the signal voltage VA, which is at +5 volts during that time. As a consequence, the voltage VB at the high voltage end of the storage capacitor 404, which is coupled to the back plate electrode 410 of the pixel 412, rises to +5 volts, as depicted in FIG. 6*e,* and the voltage across the pixel Vpixel, which is equal to the difference between the voltages applied to back and front plate electrodes 410 and 411, rises to +7 volts, as depicted in FIG. 6*f.*

From time t1 to t3, the first control signal VCS1 is LOW so that the transistors 402 and 408 turn off, and the second control signal VCS2 is HIGH so that transistor 407 turns on, so that the signal voltage VA is decoupled from the high voltage end and coupled to the low voltage end of the storage capacitor 404. As a consequence, the voltage VB at the high voltage end of the storage capacitor 404 rises to +10 volts, as depicted in FIG. 6*e,* and the voltage across the pixel Vpixel rises to +12 volts, as depicted in FIG. 6*f.*

From time t3 to t4, the first control signal VCS1 returns HIGH, turning on transistors 402 and 408, and the second control signal VCS2 returns LOW, turning off transistor 407, resulting in the voltage across the storage capacitor 404 being discharged through the transistor 408, since the signal voltage VA coupled to the high voltage end of the storage capacitor 404 is at 0 volts during this time. As a consequence, the voltage VB at the high voltage end of the storage capacitor 404 falls to 0 volts, as depicted in FIG. 6*e,* and the voltage across the pixel Vpixel falls to −12 volts, as depicted in FIG. 6*f,* since the voltage on the front plate electrode 411 is +12 volts during this time.

From time t4 to t5, both the first and second control signals VCS1 and VCS2 are LOW, turning off all transistors 402, 408 and 407, resulting in the voltage VB at the high voltage end of the storage capacitor 404 staying at 0 volts, as depicted in FIG. 6*e,* and the voltage across the pixel Vpixel staying at −12 volts, as depicted in FIG. 6*f,* since the voltage on the front plate electrode 411 is still +12 volts during this time.

After time t5, the cycle described in reference to time period t0–t5 repeats for successive ones of such time periods.

Figure 7:
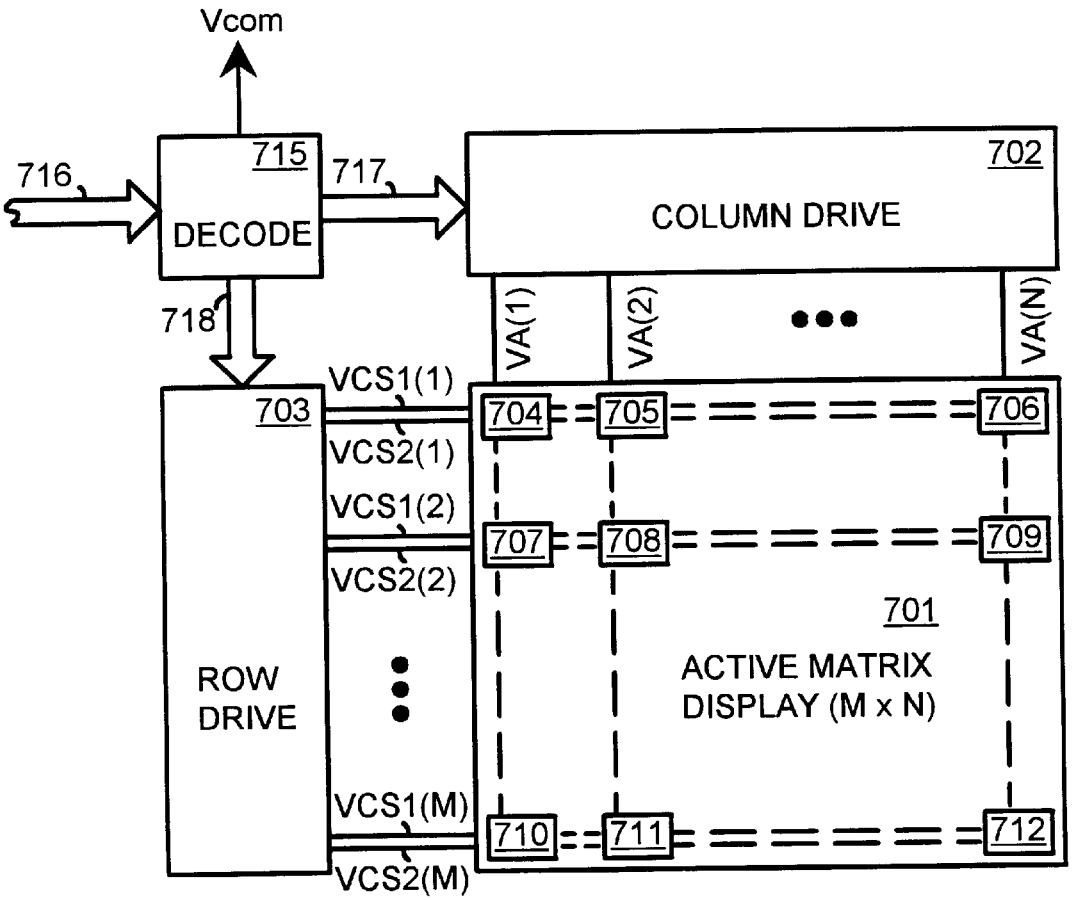
FIG. 7 illustrates, as an example, a block diagram of an active matrix display system utilizing aspects of the present invention.

FIG. 7 illustrates, as an example, a block diagram of an active matrix display system including an active matrix display 701 having a plurality of pixels organized in an array of M rows and N columns, a decode circuit 715 coupled to a host processor (not shown) through a bus 716, a row drive circuit 703 coupled to the decode circuit 715 through lines 718 and providing sets of first and second control signals (e.g, VCS1(1), VCS2(l)) to corresponding rows of pixel driving circuits (e.g., 704–706) in the active matrix display 701, and a column drive circuit 702 coupled to the decode circuit 715 through lines 717 and providing signal voltages (e.g., VA(1)) to corresponding columns of pixel driving circuits (e.g., 704–710) in the active matrix display 701, wherein each of the pixel driving circuits (e.g., 704–712) resembles the pixel driving circuit 400 of FIG. 4.

Although the various aspects of the present invention have been described with respect to preferred embodiments, it will be understood that the invention is entitled to full protection within the full scope of the appended claims.

What is claimed is:

1. A circuit for providing a back plate voltage to a back plate electrode of a pixel in an active matrix display, such that said back plate voltage is approximately twice that of a signal voltage indicative of a desired display level for said pixel, said circuit comprising:

a storage capacitor having first and second ends, said storage capacitor first end coupled to said backplate electrode, and switching means responsive to at least one control signal for coupling said signal voltage to said storage capacitor first end until a capacitor voltage approximately equal to said signal voltage is generated across said storage capacitor, and decoupling said signal voltage from said storage capacitor first end and coupling said signal voltage to said storage capacitor second end so that said storage capacitor first end provides said back plate voltage having approximately twice the voltage of said signal voltage to said back plate electrode.

2. The circuit as recited in claim 1, said at least one control signal including a first control signal and a second control signal, wherein said switching means comprises:

a first transistor having a drain coupled to said signal voltage, a source coupled to said storage capacitor first end, and a control gate coupled to said first control signal so that said signal voltage is coupled to and decoupled from said storage capacitor first end by turning on and off said first transistor, and a second transistor having a drain coupled to said signal voltage, a source coupled to said storage capacitor second end, and a control gate coupled to said second control signal so that said signal voltage is coupled to and decoupled from said storage capacitor second end by turning on and off said second transistor.

3. The circuit as recited in claim 2, wherein said switching means further comprises a third transistor having a drain coupled to said storage capacitor second end, a source coupled to a low voltage reference, and a control gate coupled to said first control signal such that said third transistor is turned on while said signal voltage is coupled to said storage capacitor first end, and turned off while said signal voltage is coupled to said storage capacitor second end.

4. A charge pump circuit for providing a back plate voltage to a back plate electrode of a pixel defined by said back plate electrode, a front plate electrode and a volume of liquid crystal material residing in between said back and front plate electrodes, such that said back plate voltage is approximately twice that of a signal voltage received by said charge pump circuit and indicative of a desired display level for said pixel, said charge pump circuit comprising:

a storage capacitor having first and second ends, said storage capacitor first end coupled to said backplate electrode, and switching means responsive to at least one control signal for coupling said signal voltage to said storage capacitor first end until a capacitor voltage approximately equal to said signal voltage is generated across said storage capacitor, and decoupling said signal voltage from said storage capacitor first end and coupling said signal voltage to said storage capacitor second end so that said storage capacitor first end provides said back plate voltage having approximately twice the voltage of said signal voltage to said back plate electrode.

5. The charge pump circuit as recited in claim 4, said at least one control signal including a first control signal and a second control signal, wherein said switching means comprises:

a first transistor having a drain coupled to said signal voltage, a source coupled to said storage capacitor first end, and a control gate coupled to said first control signal so that said signal voltage is coupled to and decoupled from said storage capacitor first end by turning on and off said first transistor, and a second transistor having a drain coupled to said signal voltage, a source coupled to said storage capacitor second end, and a control gate coupled to said second control signal so that said signal voltage is coupled to and decoupled from said storage capacitor second end by turning on and off said second transistor.

6. The charge pump circuit as recited in claim 5, wherein said switching means further comprises a third transistor having a drain coupled to said storage capacitor second end, a source coupled to a low voltage reference, and a control gate coupled to said first control signal such that said third transistor is turned on while said signal voltage is coupled to said storage capacitor first end, and turned off while said signal voltage is coupled to said storage capacitor second end.

7. A back plate structure for a liquid crystal display, comprising:

a reflective electrode, a storage capacitor coupled to said reflective electrode, and formed substantially beneath said reflective electrode so as to be screened by said reflective electrode from incident light entering said liquid crystal display, and switching means responsive to at least one control signal for coupling said signal voltage to said storage capacitor first end until a capacitor voltage approximately equal to said signal voltage is generated across said storage capacitor, and decoupling said signal voltage from said storage capacitor first end and coupling said signal voltage to said storage capacitor second end so that said storage capacitor first end provides said back plate voltage having approximately twice the voltage of said signal voltage to said back plate electrode, said switching means also formed substantially beneath said reflective electrode so as to be screened by said reflective electrode from incident light entering said liquid crystal display.

8. The back plate structure as recited in claim 7, said at least one control signal including a first control signal and a second control signal, wherein said switching means comprises:

a first transistor having a drain coupled to said signal voltage, a source coupled to said storage capacitor first end, and a control gate coupled to said first control signal so that said signal voltage is coupled to and decoupled from said storage capacitor first end by turning on and off said first transistor, and a second transistor having a drain coupled to said signal voltage, a source coupled to said storage capacitor second end, and a control gate coupled to said second control signal so that said signal voltage is coupled to and decoupled from said storage capacitor second end by turning on and off said second transistor.

9. The back plate structure as recited in claim 8, wherein said switching means further comprises a third transistor having a drain coupled to said storage capacitor second end, a source coupled to a low voltage reference, and a control gate coupled to said first control signal such that said third transistor is turned on while said signal voltage is coupled to said storage capacitor first end, and turned off while said signal voltage is coupled to said storage capacitor second end.

10. A method of generating a voltage for a back plate electrode for a pixel of a liquid crystal display, comprising the steps of:

charging a storage capacitor coupled to said back plate electrode to a signal voltage, and charging said storage capacitor to a voltage approximately twice the voltage of said signal voltage by coupling said signal voltage to a low voltage end of said storage capacitor.

11. The method as recited in claim 10, wherein said first charging step comprises the steps of:

coupling said signal voltage to the back plate coupled end of said storage capacitor, and coupling a low reference voltage to said low voltage end of said storage capacitor.

12. The method as recited in claim 11, wherein said second charging step comprises the steps of:

decoupling said signal voltage from said back plate coupled end of said storage capacitor, decoupling said low reference voltage from said low voltage end of said storage capacitor, and coupling said signal voltage to said low voltage end of said storage capacitor.

* * * * *